US005144728A

United States Patent [19]

Hagenbuch

[11] Patent Number: 5,144,728

[45] Date of Patent: Sep. 8, 1992

[54] METHOD FOR MANUFACTURING A SEMIFINISHED MATERIAL FOR FORMING A BLOSSOM-TYPE DECORATION

[75] Inventor: Ernst Hagenbuch, Breitenbach, Switzerland

[73] Assignee: Bandfabrik Breitenbach AG, Breitenbach, Switzerland

[21] Appl. No.: 608,304

[22] Filed: Nov. 2, 1990

[30] Foreign Application Priority Data

Nov. 9, 1989 [DE] Fed. Rep. of Germany ..... 3937348

[51] Int. Cl.[5] ..... D04D 7/10

[52] U.S. Cl. ..... 28/147; 223/46; 428/4

[58] Field of Search ..... 28/147, 150; 223/46, 223/2; 428/4; 2/244

[56] References Cited

U.S. PATENT DOCUMENTS

| | | | |
|---|---|---|---|
| 1,587,294 | 6/1926 | Gallagher | 428/4 X |
| 3,539,431 | 11/1970 | Schmidt et al. | 223/46 X |
| 3,632,464 | 1/1972 | Grikis | 428/4 |
| 3,676,277 | 7/1972 | Truskolaski | 428/4 |
| 4,656,064 | 4/1987 | Cheng | 223/46 X |
| 4,822,648 | 4/1989 | Cheng | 223/46 X |
| 4,963,411 | 10/1990 | Protz, Jr. | 223/46 X |
| 5,008,961 | 4/1991 | Hubbard et al. | 2/197 X |

FOREIGN PATENT DOCUMENTS

| | | | |
|---|---|---|---|
| 151220 | 4/1951 | Australia | 428/4 |
| 0208804 | 11/1988 | European Pat. Off. . | |
| 2002776 | 7/1970 | Fed. Rep. of Germany . | |
| 1951542 | 4/1971 | Fed. Rep. of Germany | 428/4 |
| 3505549 | 9/1985 | Fed. Rep. of Germany . | |
| 1026687 | 4/1953 | France | 428/4 |
| 370028 | 7/1963 | Switzerland . | |

*Primary Examiner*—Werner H. Schroeder
*Assistant Examiner*—Sara M. Current
*Attorney, Agent, or Firm*—W. G. Fasse

[57] ABSTRACT

A method for the manufacture of a semifinished material prepares such material for the subsequent production of a flower-like or petal-like decoration. For this purpose an initially flat band ribbon or tape material, that is sufficiently flexible for the subsequent folding to form pleat-like folds, is provided in its lengthwise direction with at least one drawstring which itself is also sufficiently flexible. The drawstring is secured at spaced intervals to the flat material, so that the drawstring is free from the flat material outside the securing points or areas. In these free intervals or spacings the drawstring is not covered by the flat material such as a flexible ribbon. At least one longitudinal edge of the flat material is provided with a non-linear contour which subsequently helps forming a flower or petal-like appearance. The free or non-covered sections of the drawstring are so dimensioned that a desired folding size of the pleat-like folds, to be formed later simply by pulling on the drawstring, is achieved.

30 Claims, 8 Drawing Sheets

METHOD FOR MANUFACTURING A SEMIFINISHED MATERIAL FOR FORMING A BLOSSOM-TYPE DECORATION

FIELD OF THE INVENTION

The invention relates to a method for manufacturing a semifinished material for forming or producing a blossom-type decoration.

BACKGROUND INFORMATION

It is generally known to manufacture bands, ribbons, tapes, and the like out of the most varied types of materials such as woven fabrics, double-ribbed materials, non-woven materials, such as plastic sheets, paper webs, or the like.

European Patent Publication No. 0,208,804 (Hagenbuch) discloses a semifinished packaging material which, under certain conditions, could be used to produce rosette-type structures (FIG. 6). Such structures are decorative, but hardly resemble a flower or blossom with its individual petals. The primary objective was to create a decorative package for individual items. Any resemblance to a flower or blossom was not intended.

Swiss Patent No. 370,028 (Maar et al.) discloses a semifinished material, which offers a simple way to form a rosette out of loops for decorating purposes. To create such a rosette, the semifinished material, which consists of a ribbon with parallel edges, must be pushed tightly along one or two draw strings. The character of a rosette is lost if the ribbon is not gathered tightly together and then tied with a knot in the gathered position. Again, a decorative rosette is created from loop-like structures which do not resemble a flower or blossom.

German Patent Publication DE-OS 3,505,549 (Cheng) discloses a double ribbon, wherein two individual ribbons, laid one on top of the other, have corresponding notches in their edges at equal longitudinal distances. At the notches the two ribbons are held together by fasteners through which two drawstrings can freely move. Pushing the ribbons together along the drawstrings creates multi-loop bows forming cruciform rosettes of four loops each on top of each other around a common center. Such a ribbon, however, is costly in its manufacture. Besides, it is difficult to cut off a single layer of four loops while leaving enough drawstring exposed for the fixation of the rosette by tying a knot. Formation of the rosette by several layers of loops on top of each other, however, still resembles merely a multi-loop decorative bow.

German Patent Publication DE-2,002,776 (Pearson et al.) based on U.S. Ser. No.: 791,992, filed Jan. 17, 1969, discloses prefabricated loop blanks and devices for their manufacture. The loop blanks are used for pompon loops. The blanks comprise a double ribbon with a central string. Ribbons and string are glued to each other at spaced intervals. The ribbons are notched to facilitate twisting of loops into a bow-type pompon.

OBJECTS OF THE INVENTION

In view of the above it is the aim of the invention to achieve the following objects singly or in combination:

to propose a method for the manufacture of a semifinished material suitable to create a flower-like or blossom type decoration with petal-like leaves rather than loops;

to provide a simple and inexpensive semifinished product, which permits the creation of the flower-like, blossom-type decoration in a most simple way, out of a variety of most differing types of materials;

to produce the present semifinished material out of any suitable material that is sufficiently flexible for the intended purpose, namely to form a blossom-type or flower-like decoration which does not have loops or bows in its structure;

to manufacture the semifinished material as a so-called "endless" product that can be rolled up just like conventional bands, ribbons, tapes, for its subsequent use in the formation of the decorations without loops;

to construct the semifinished product in such a way, that any suitable length can be cut off from its supply roller;

to provide a semifinished product that can be formed into various shapes of flower-like, blossom-type decorations, such as flowers having smaller inner petals and larger outer petals, or which has a desired folding characteristic or folded size in the finished product;

to modify a band, ribbon, tape, or the like which can be folded into a decoration, in such a way that its folding characteristic is influenced by the modification;

to provide a semifinished product, the characteristics of which determine the shape, configuration, and size of the finished product;

to prepare as a semifinished product a plurality of flat bands, ribbons, or tapes so that they have a common longitudinal axis for forming an especially rich or full multi-layered blossom-type decoration; and to cut a normally flat tubular band, ribbon, or tape radially or approximately radially for the subsequent formation of a blossom-type decoration.

SUMMARY OF THE INVENTION

In accordance with the invention these objects are achieved by a ribbon of optional but suitably flexible material, manufactured by any suitable methods. The ribbon is provided lengthwise with at least one straight running, flexible tension member such as a drawstring or draw-wire, which, in sections along the lengthwise direction, is not covered by the flexible ribbon. At least one edge of the ribbon is made with a non-linear contour along the entire ribbon length and free sections of the tension member are dimensioned such that a desired folding size to form flower or blossom-type structures is achieved when the ribbon is pushed together along the drawstring. The term "ribbon" is used herein to cover all types of elongated flat or tubular material, such as bands, tapes, and the like.

Ribbons to be used for the present purposes must have a sufficient flexibility. Such a flexible ribbon is now provided with at least one straight running tension member also referred to as "drawstring" herein with the intention to cover all suitable elongated means suitable for the pulling, such as ropes, wires, bands, and the like. This drawstring must not be completely covered by a continuous noose or by the material of the ribbon. Rather, similar to a weft thread in a textile fabric, the drawstring must partially not be covered by the ribbon, so that the ribbon can separate in these areas from the drawstring for forming folds in the manner of pleats, especially curved pleats, when the ribbon is pushed up along the drawstring. With a simple smooth ribbon, for example, this feature that the drawstring is not covered by the ribbon, and hence free of the ribbon, is achieved when the drawstring runs in regular or irregular intervals once on one side and then on the other side of the ribbon. The change from one side of the ribbon to the other side is achieved by penetrating the ribbon with the drawstring and at the same time holding the drawstring in place by the ribbon material at the penetration location. This guiding of the drawstring is possible in all kinds of ribbon material. The connection between ribbon and drawstring at the point of penetration is made by any suitable bonding, e.g. by an adhesive, by a heat welding, or the like.

The non-linear contour of one ribbon edge assures that, when the ribbon is pushed together on the drawstring to form the curved pleats, this non-linear edge contour takes on the form of a petal of a flower when at the same time the free sections on the drawstring are dimensioned in their length so that a folding or pleat size is achieved, which corresponds to the form of the non-linear contour. When now the ribbon is loosely pushed together on the flexible drawstring, the two remaining ends of the drawstring can now be brought together and tied with a knot. The result is a nearly circular flower or blossom center which distinctly enhances the blossom- or flower-like appearance.

Numerous variations which change the appearance of the flower or blossom are possible. In all cases the semifinished material of the invention can be manufactured as a so-called endless product which must be cut into pieces of suitable length for the creation of a flower-like decoration. For this purpose, pieces of suitable length may be marked or pre-impressed on the semifinished material so that they can simply be separated by tearing them off. It is also useful to lightly fasten the drawstring to the ribbon at the end point of separation between two sections, so that, after separation, the section can simply be pushed up along the string to form the flower-like decoration. In this case, it becomes unnecessary to tie the drawstring at one end to avoid pulling it through.

To create other forms of flowers or blossoms it is possible to shape both ribbon edges with a non-linear contour, preferably a wavy, arch, or arcade-like contour. With such contours, the size of the arches or the length and depth of the waves or pleats can readily vary over the length of a section, whereby for example, it becomes possible to create smaller inner petals and larger outer petals in the resulting flower decorations.

According to the invention it is, for example, preferable to strengthen areas on the ribbon along the drawstring. These strengthened areas can extend throughout the entire length or only over certain parts of the length. This feature influences the folding or curling behavior of the ribbon during the pushing-up along the drawstring in a desirable way. The type of influence depends on the stiffness of the ribbon, on the width, and on the length of the strengthened area of the ribbon. Simple tests permit the determination of suitable forms for the strengthened areas to achieve the desired effect. The drawstring can be placed in the most varied positions over the width of the ribbon. Strengthened areas can thereby be placed either on one side or on both sides of the drawstring. When both edges of the ribbon are to be provided with a contour by punching or cutting with corresponding rollers, it may be advantageous to position the drawstring exactly in the center of the ribbon, to fold the ribbon lengthwise, and to cut or punch the contour in a single operation for both sides. However, it may also be advantageous with such a folded ribbon to put the drawstring not centrally in the fold, but right next to the fold on one side of the ribbon. If required, a strengthening strip may be placed on the other side of the folded ribbon along the folding edge. This feature creates particularly sumptuous, decorative flower structures when the ribbon is pushed together on the drawstring.

In textile ribbon structures the drawstring can be manufactured at the same time with the ribbon. However, the drawstring also can later be stitched in or stitched on. Later addition is advantageous when the ribbon, for example, is made from plastic sheets or paper. The drawstring can then be lead through attached loops which must, however, again be dimensioned in their width and separation to yield the desired folding or pleat size. However, the ribbon itself can be toothed along one of its edges, with rectangular teeth which protrude laterally like tongues and have a suitable spacing beween neighboring tongues. These tongues can then be folded around an enclosed drawstring and with their free end be fastened to the ribbon, for example, by gluing, stitching, or other suitable attachment measures.

The longitudinal free spacing between the individual tongues again provides with appropriate dimensioning, the desired folding or pleat size. The folding size can be influenced by the mentioned free spacing, but also by the width of the tongues themselves. Thus, a variation in the size of the spacings and in the width of the tongues can provide for a corresponding variation in the folding size, such that it is possible to build-up a flower with increasing petal size from inside to the outside.

To simplify the manufacturing of the ribbon it is possible to provide a drawstring on both edges of a ribbon. Such a ribbon then needs only to be cut with a non-linear contour in the region between the two drawstrings, whereby two suitable ribbons are produced, each with a straight edge where the drawstring is located and a non-linear or curved edge where the cut or punching was made. The same method can also be used to produce two ribbons which have a non-linear contour on both edges. For this purpose, the ribbon is formed as a tube which is then layed flat and cut between the two folding edges. With this arrangement, it is possible to position the drawstring either in the folding edge itself or right next to it so that, after the cutting, two ribbons are created with non-linear contours on both edges and either with a centered or an off-center drawstring. In the off-center case it is again possible to provide a strengthening strip on the other side. In the centered case, the strengthening strip can also be positioned on both sides of the drawstring. These strengthening strips can already be worked into the manufacturing of the ribbon, or be affixed later on.

For forming decoration flowers or blossoms to which there is solidly secured a container for holding a single item or a plurality of individual items, it is possible to secure a hose band to a flat ribbon along its longitudinal edge to form a single piece, integral unit. The second edge of the flat ribbon is then provided with the non-linear curved contour. A drawstring may be arranged along the connecting edge between the flat and hose-type ribbons. However, the location of the drawstring is not limited to the connecting edge. In fact, the drawstring may be located along in the flat ribbon or on the side of the hose-type ribbon. Reinforcement strips may also be used in such a structure as just described. Further, a hose-type band may be combined with two flat ribbons, one along each straight edge of each flat ribbon. The flat ribbon is then cut along a curved line intermediate or between its straight edges, to which the hose-type bands are connected, whereby again two intermediate material ribbons are formed simultaneously.

An especially sumptuous and multi-layer flower-like or blossom-like decoration according to the invention results, if several flat ribbons are secured to one another along a common longitudinal edge. A drawstring may be arranged as taught herein in the area of the common edge. The free edges of all flat ribbons are the cut or punched to form the non-linear, curved contour. However, the curved contour may also be produced, e.g., directly as part of the production process of the flat ribbon.

The manufacturing of such ribbons becomes particularly efficient, if a suitably wide flat ribbon is fitted with drawstrings along each of its straight edges as well as in the center. Such a ribbon can be folded along the central drawstring and be cut with a non-linear contour in the area between the folded and the straight outer edges. In this way three ribbons are created simultaneously. In the method just described the central drawstring can be supplemented with strengthening strips on one or both sides. It is equally possible to position the drawstring not in the center, but somewhat off-center or next to the center and to provide strengthening strips on the other side next to the center, which forms the folding edge.

Through introduction of another drawstring which extends not only longitudinally, but also laterally in the areas of arcs or arcades toward the highest point of such arcs and back, it is possible with this drawstring to further pull in the petals of the flower in order to achieve an even more realistic look of the present decorations.

A particularly simple ribbon as a semifinished material results when a tube-or hose-like ribbon is fitted lengthwise with at least one drawstring and subsequently is cut crosswise or approximately radially in regular or irregular spacings along its length, whereby loops are formed in the hose-type ribbon. These cuts must not reach all the way to the drawstring. Here, as in all cases, the drawstring must be guided as described before, so that free areas remain where the folding occurs. The ribbon structure which results from the just described method can be left in its own form but it is also possible to cut the individual loops open at their apex away from the drawstring, either after the procedure or prior to pushing the loops together.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
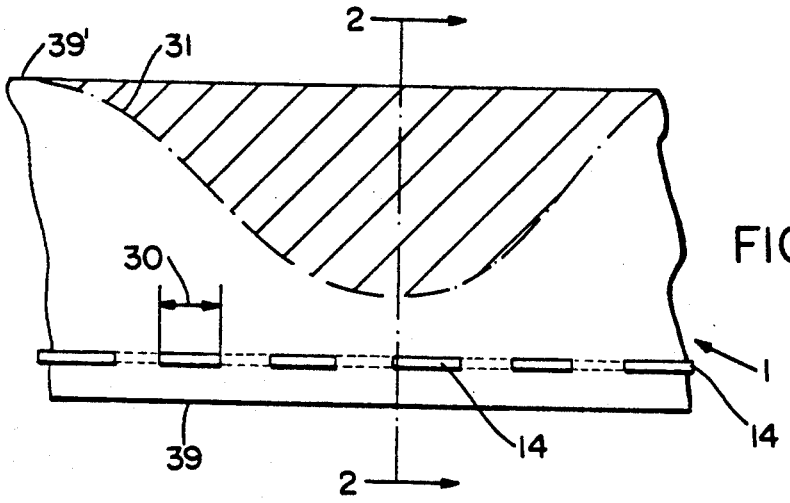
FIG. 1 is a plan view of a first embodiment of a semifinished ribbon material of the invention shown prior to the severing step.

FIG. 1 shows a longitudinal section of a piece of flat ribbon made of any suitable, sufficiently flexible material, such as textile fabric, plastic film, paper, or plastic reinforced paper, or the like. Only a portion of the entire ribbon 1 is shown in the lengthwise direction. The ribbon material is sufficiently flexible, if pleats can be folded, as will be described in more detail below.

Figure 2:
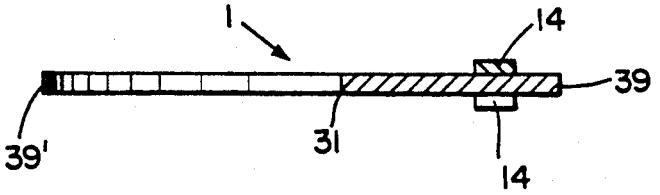
FIG. 2 is a sectional view along section line 2—2 in FIG. 1 on a somewhat enlarged scale compared to FIG. 1 after the severing.

FIG. 2 is a cross-section along line 2—2 of FIG. 1, to show that the ribbon 1 is flat. The flat ribbon 1 is fitted near its straight edge 39 with a drawstring 14 which passses alternately on the top and on the bottom side of the ribbon 1. The change from one side to the other simply happens when the drawstring 14 passes through the ribbon 1 in the appropriate direction. Through this arrangement of the drawstring 14, free string sections 30 are created alternately on the top and bottom side of the ribbon through which ribbon 1 can arch or fold when it is pushed together on the drawstring 14 to form pleats in the finished product. These sections 30 can vary in length along the longitudinal direction and the section length 30 on one side of the ribbon 1 may differ from the section length on the other side.

The second edge 39' runs initially parallel to the edge 39. However, according to the invention the second edge 39' is shaped in such a way, that a non-linear curved contour 31 is created which in the finished product forms the contours of a flower-like or blossom-like decoration. The shaded area becomes waste when the non-linear contour 31 is made by a severing operation, e.g., a cutting or punching process. However, textile ribbons, for example, can be woven so that the shaded area can be avoided by an appropriately controlled weaving process. The width of the ribbon and the depth of the arc or curve of the non-linear contour 31 depends on the desired form of the flower-like or blossom-like appearance of the decoration to be produced. The dimensions of the curvature and its configuration are determined by the size and contour of the flower and the desired from of the petals. The distances 30 must be dimensioned such that the desired petal curvature is achievable. For this purpose, it will normally be necessary to vary the distances 30 over the extent of the curvature in such a way that the distances 30 decrease toward the low point of the curve, where the distance between the curve 31 and the drawstring 14 is least, and to let the distance 30 increase where the spacing between curve 31 and the string 14 increases.

Figure 3:
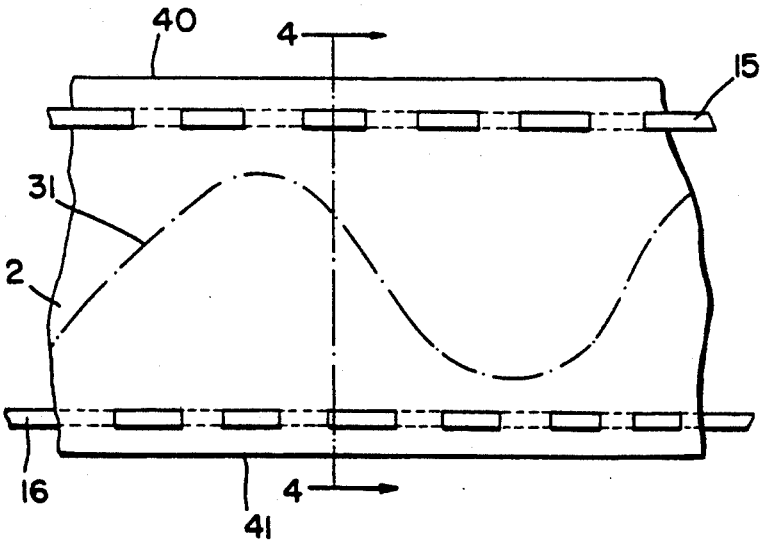
FIG. 3 is a view similar to FIG. 1, but illustrating the formation of two semifinished ribbons prior to the severing step.
Figure 4:
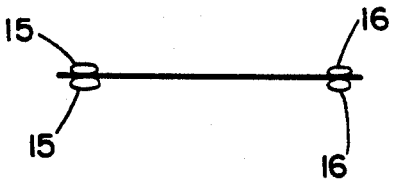
FIG. 4 is a sectional view along section line 4—4 in FIG. 3 on an enlarged scale also prior to the severing step.

FIGS. 3 and 4 show a flat ribbon 2 in a form very similar to FIG. 1, whereby the ribbon 2 is distinguished from ribbon 1 of FIG. 1 in that each of the ribbon edges 40 and 41 is provided with a drawstring 15 and 16 respectively. The ribbon 2 can now be separated along a non-linear or curved contour 31 in the area between the drawstrings 15 and 16, so that two draw ribbons are formed. Position and arrangement of the drawstrings 15, 16 is then as described with reference to FIG. 1.

Figure 5:
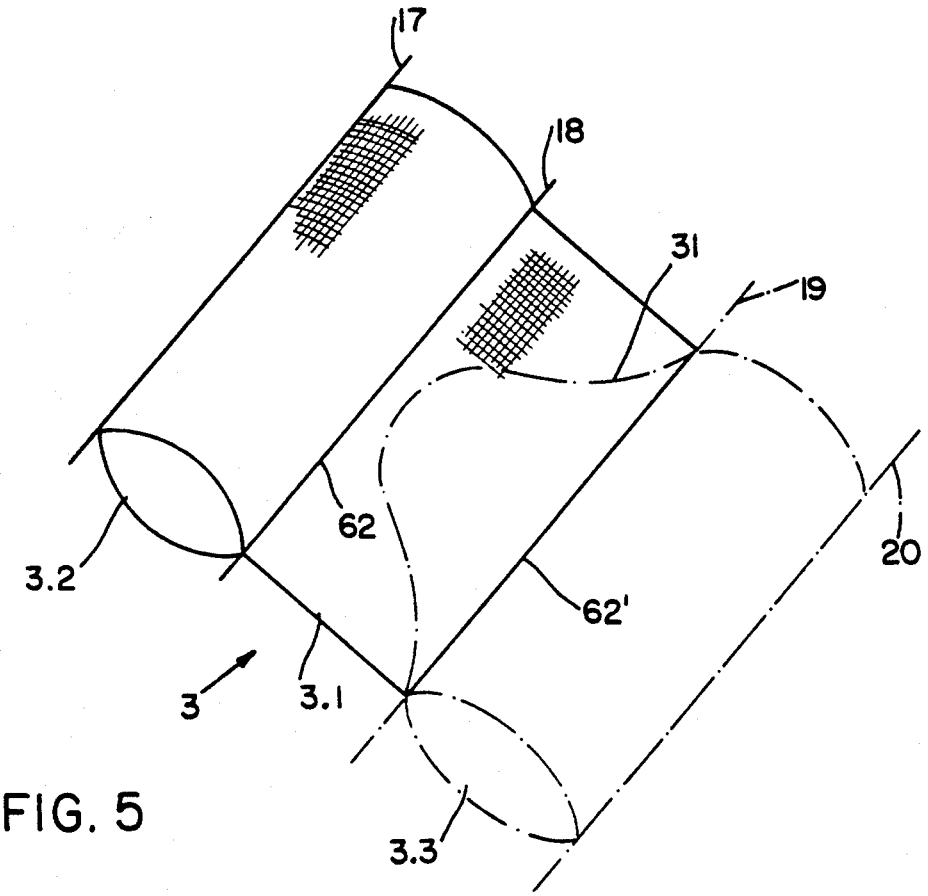
FIG. 5 shows a perspective view of an embodiment with a flat ribbon connected to one or two hose-type bands prior to the severing step.

FIG. 5 shows a variation in the form of a ribbon 3 in which a flat ribbon 3.1, for example as shown in FIG. 1, is attached to a tubular ribbon 3.2 along its edge 62. A drawstring 18 is provided immediately next to or along the edge 62 as indicated in FIG. 5. Here again, it should be pointed out that the draw string 18 shall be arranged as the draw strings 14, 15, 16, so that the necessary distances for the formation of folds or pleats are created. The tubular ribbon 3.2 can, if desired, be provided with another drawstring 17 running lengthwise which, for example, can be placed diametrically opposed to the drawstring 18. This placement, however, is not mandatory.

The other free longitudinal edge 62' of the flat ribbon 3.1 is formed with a non-linear contour 31. However, it is also possible to connect another tubular ribon 3.3 along this free edge 62' as shown by dash-dotted lines in FIG. 5. Corresponding to drawstrings 18 and 17 this further tubular ribbon 3.3 is provided with drawstrings 19 and 20. If the flat ribbon 3.1 is severed in the area between the two drawstrings 18 and 19 along the curvature 31 as has been described for flat ribbon 2 in FIG. 4, two identical ribbons will result without any waste. The tubular ribbons 3.2 and 3 can in this arrangement be used as receptacles for one or more small items. The receptacle is then fitted with a flower-like rosette at the same time.

After the pushing together along the drawstring 18 and its appropriate knotting the receptacle is then at the same time fitted with a flower-like decoration. Normally, a special closure at the two open ends of the receptacle formed by the tubular ribbons 3.2, 3.3 is not required. Such a closure may, however, be provided in any optional way.

Figure 6:
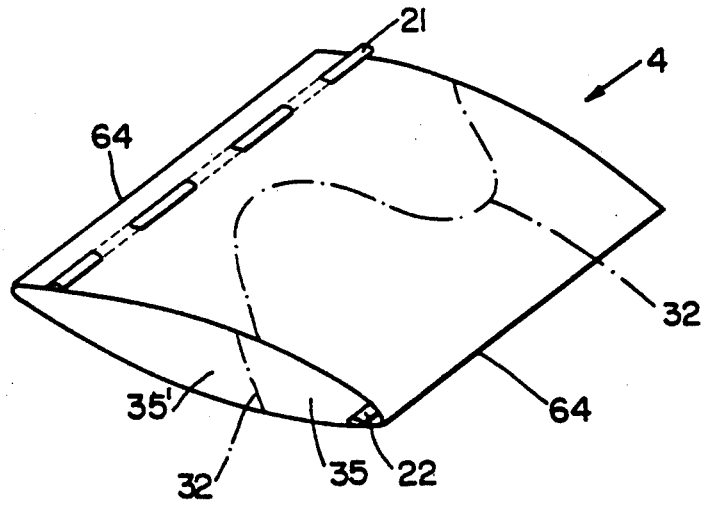
FIG. 6 is a perspective view of an embodiment of forming two semifinished ribbons out of a hose-type band prior to the severing.

FIG. 6 shows a ribbon 4 of tubular form, which is initially flattened, so that folding edges 64 are formed. Drawstrings 21 and 22 are provided near these folding edges, one on each ribbon half 35, 35', or in the folds themselves. In the implementation example of FIG. 6 the drawstrings are shown next to the folding edges respectively. Here again, the arrangement of the draw strings is the same as already described with reference to FIGS. 1 and 3. The ribbon 4 of FIG. 6 can now be severed, e.g. punched or cut in a single process, through both of its halves, to achieve the non-linear contours 32, whereby two identical ribbons are produced each with a non-linear, curved contour along both of its edges.

Incidentally, it is also possible to treat the ribbon 3 in the configuration of FIG. 5 in such a way, that the attached tubular part 3.2, 3.3 of the ribbon 3.1 is cut in the manner just described for ribbon 4 of FIG. 6, whereby a compound ribbon as will be further described with reference to FIG. 7 and an additional ribbon with two edges cut along a non-linear contour are formed.

Figure 7:
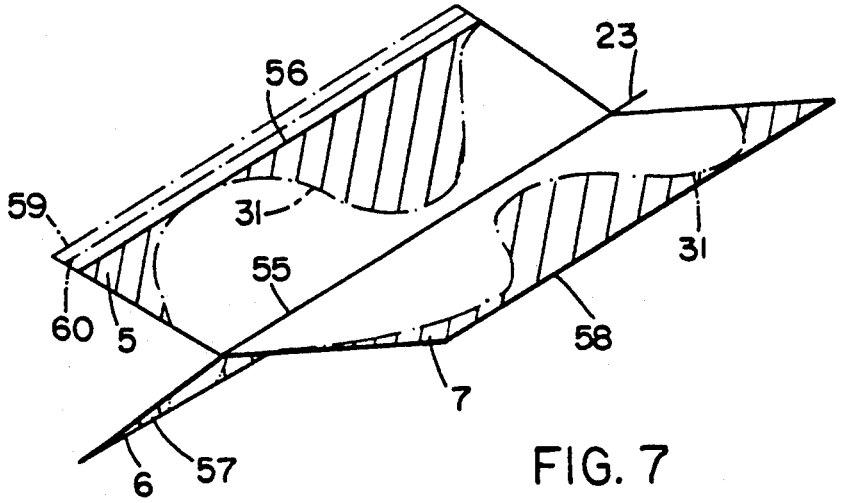
FIG. 7 is a perspective view of a semifinished material comprising three flat ribbons connected to one another along a common longitudinal edge, prior to the severing.

FIG. 7 shows a ribbon which is put together by connecting several individual flat ribbons 5, 6, and 7 along a common straight edge 55. A drawstring 23 is provided in the area of the common straight edge 55. The flat ribbons 5, 6, 7 have free straight edges 56, 57, and 58. Non-linear contours 31 are cut or punched into the flat ribbons so that the shaded areas are wasted. This waste can, however, be avoided when the flat ribbons 5, 6, and 7, or at least one of them, is configured such that they have an outer edge 59 as shown by a dash-dotted line in FIG. 7, and if a drawstring 60 is arranged in the area of the outer edge 59 as described above. A cut along line 31 to make the appropriate non-linear contour leaves at the same time another outer ribbon of the form of FIG. 1. Waste is thereby avoided.

Figure 8:
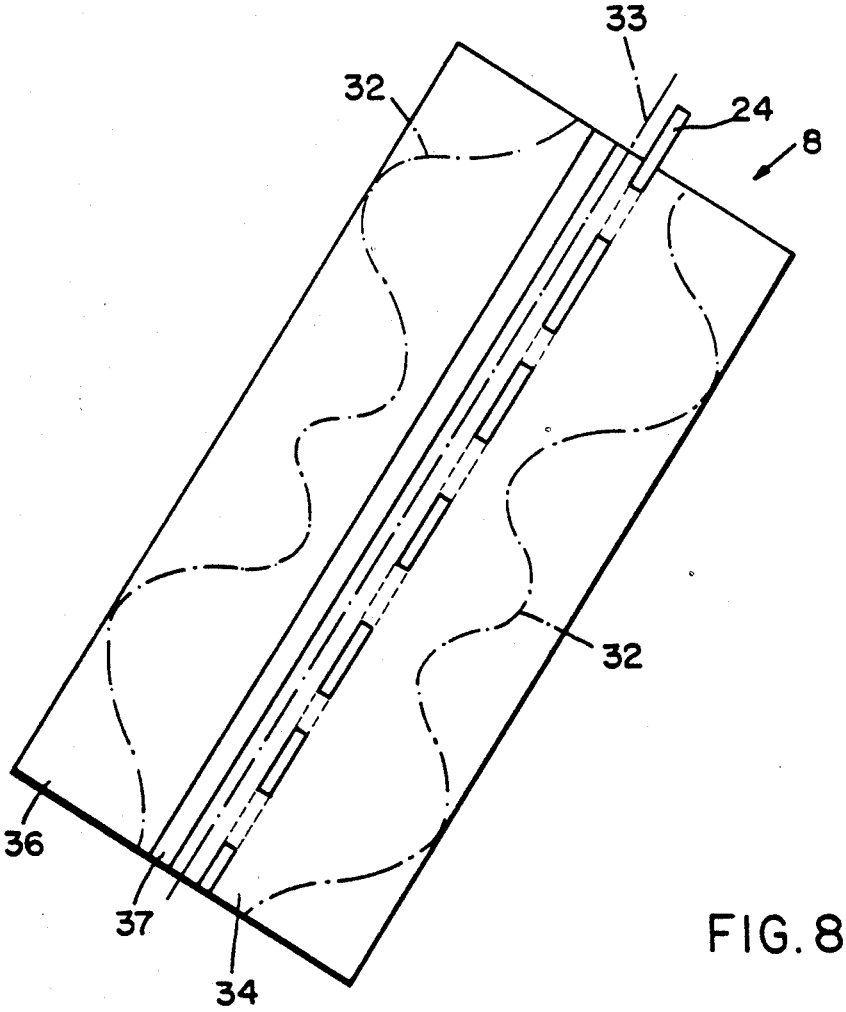
FIG. 8 is a plan view of an embodiment with one tension member and one reinforcing member prior to severing or forming the outer edges.

A flat ribbon 8 of FIG. 8 shows a ribbon center 33 and on one side along the center 33 a drawstring 24 arranged as described. A strengthening strip 37 is located on the other side of the center 33. This strengthening strip 37 can be provided in sections only. For the manufacture of the semifinished material, the ribbon 8 will be folded along the center 33, so that one ribbon half 34 is layed on top of the other ribbon half 36. In this position the non-linear contour 32 is cut or punched, so that the shaded areas become waste. However, this waste can be avoided through a changed process as already described with reference to FIG. 7 and which will be described in further detail below with reference to FIG. 13.

Figure 9:
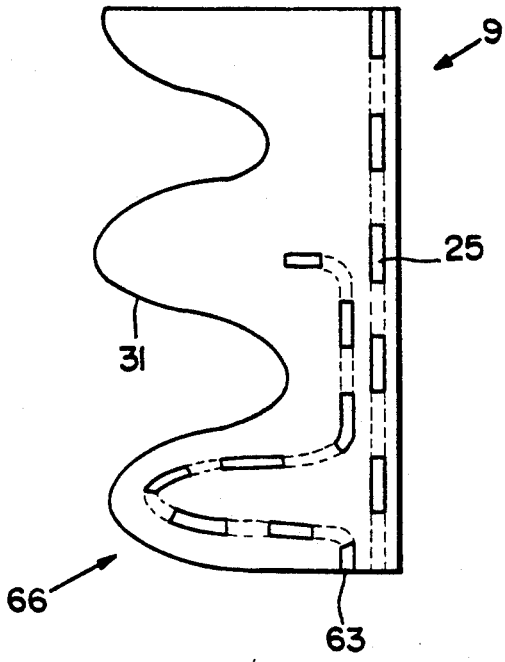
FIG. 9 is a plan view similar to that of FIG. 1, with two tension members and subsequent to the formation of the curved edge.

FIG. 9 shows a direct plan view of a section of ribbon 9 which corresponds in its main structure to the flat ribbon of FIG. 1. Here again, the drawstring 25 extends along the straight edge just as drawstring 14 is positioned in ribbon 1 in FIG. 1. The ribbon 9 of FIG. 9, however, has another drawstring 63 which in some areas runs near and parallel to drawstring 25, while in other areas the drawstring 63 runs substantially along the contour 66. The drawstring 63 runs, in the same manner as drawstring 25, alternately on the top or bottom side of the ribbon 9. Near the top of the arcs or curves 66 of FIG. 9 the drawstring 63 is lead up into the upper region of the arc and back down. This makes it possible to further pull together the petals formed by the arcs or curves, so that a more natural, three-dimensional form of the petals results either while the flower is formed or later.

Figure 11:
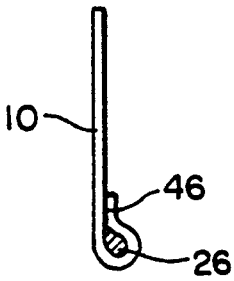
FIG. 11 is a view in the direction of the arrow A in FIG. 10.
Figure 10:
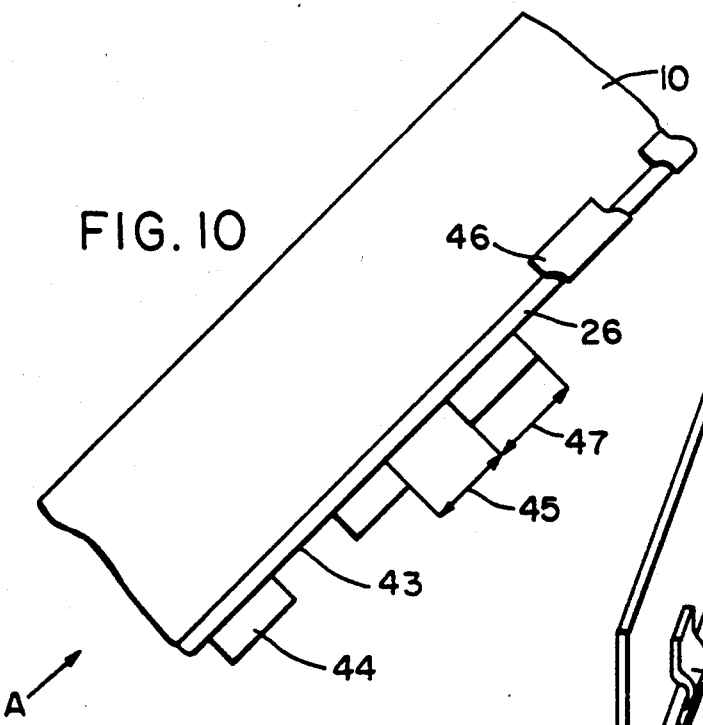
FIG. 10 is a plan view illustrating one possibility of attaching a tension applying member.
Figure 12:
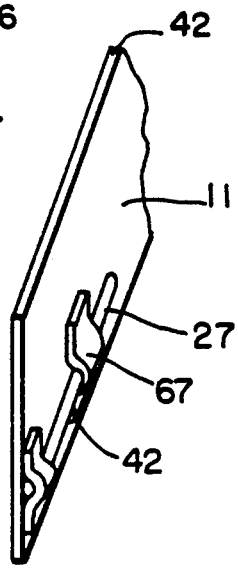
FIG. 12 is a perspective view of a portion of a somewhat modified embodiment compared to FIG. 10.

FIGS. 10, 11, and 12 show further variations of suitable ribbons whereby FIG. 11 shows a view in the direction of arrow A in FIG. 10 showing a simple flat ribbon 10. For simplicity, the non-linear contour 31 is not shown, because FIG. 10 serves only for the description of an arrangement for holding the drawstring 26. For this purpose, ribbon 10 has rectangular, protruding tongues 44 with a width 47 along its edge 43 and a spacing 45 between neighboring tongues. Widths 47 and spacings 45 need not be the same, but can vary to achieve the desired folding distance and degree of curvature in the final decoration product. The drawstring 26 can now be placed at the root of the tongues 44 and the tongues 44 be folded around the drawstring 26 and affixed to the ribbon 10 with their free end 46. The fastening method of the folded tongues to the ribbon may use any suitable conventional method, e.g. gluing, heat bonding, etc. The result is a number of loop-like structures which hold the drawstring 26. In this arrangement the tongues 44 simultaneously act as strengthening elements.

FIG. 12 shows a perspective view of a section of a ribbon 11 with both edges 42, for simplicity, shown running straight, but at least one edge will be provided with the curvature 31 for the present purposes. The ribbon 11, for example, could be made of plastic film or paper. Parallel to one of the edges 42 or in the center runs a drawstring 27 on the top side or surface of the ribbon 11 and is held in place by fasteners 67. Thus, the drawstring 27 does not pass through the ribbon 11. The width of the fasteners 67 as well as the distance between them is again to be determined by the desired folding size as previously described. The separation distance between consecutive fasteners 67 as well as the width of the fasteners 67 itself may also vary as described above.

Figure 13:
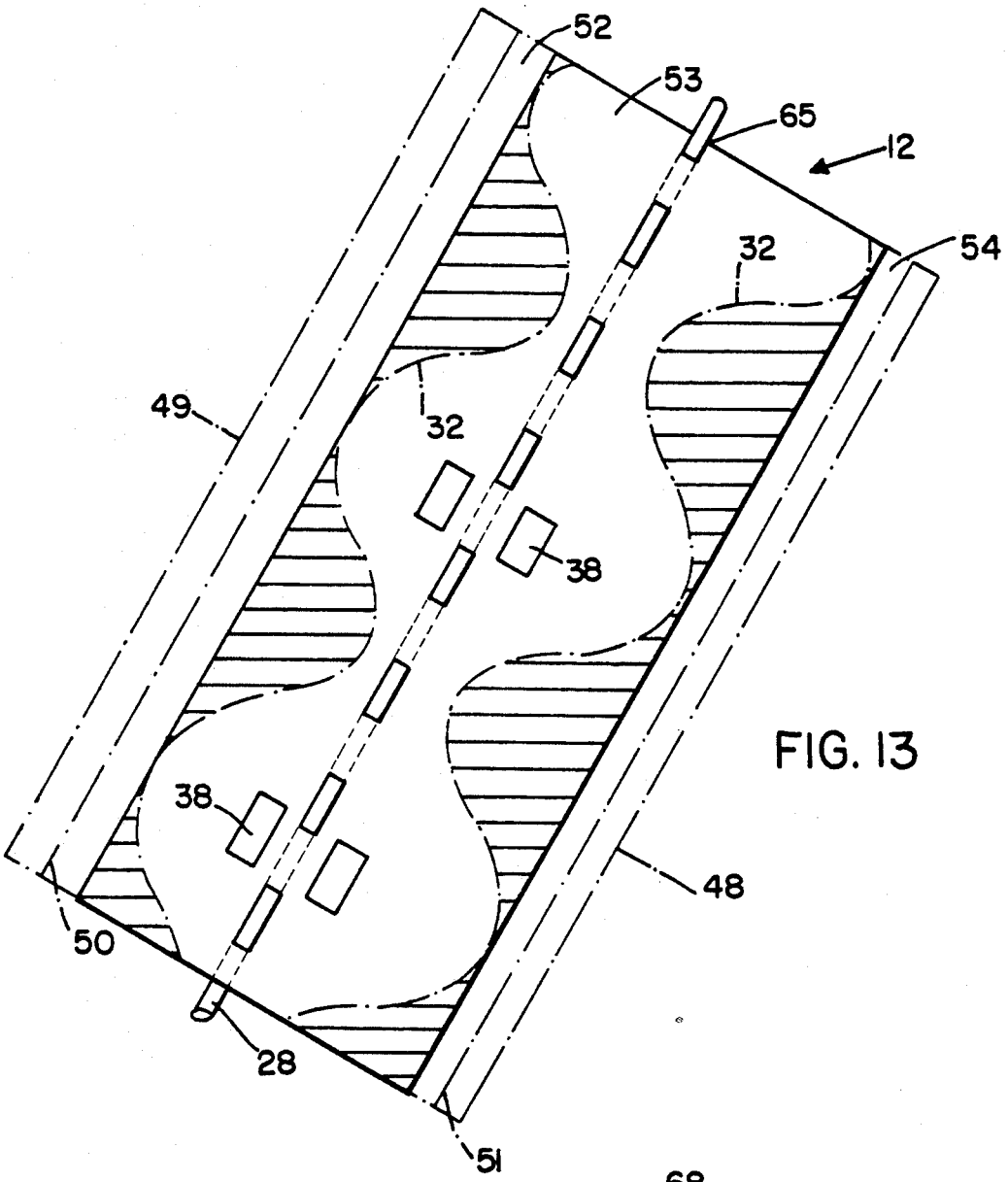
FIG. 13 is an embodiment similar to that of FIG. 8 with a centrally arranged tension member, also prior to a severing step.

FIG. 13 shows an implementation example very similar to that of FIG. 8, except that ribbon 12 has a drawstring 28 exactly in the center. Instead of strengthening strip 37 there are provided strengthening ribbon areas 38, which however, can be replaced by strengthening strips 37.

The ribbon 12 will be folded around the drawstring 28 and then the non-linear contour 32 will be cut or punched or made in any other suitable way so that a ribbon 12 is created with both edges having a non-linear contour. Shaded areas become waste. This waste can, however, be avoided when drawstrings 50 and 51 are positioned in the described manner in the area of the parallel straight edges 48 and 49, shown with dash-dotted lines in FIG. 13. Similarly, the drawstrings 50 and 51 are only shown as dash-dot-dot lines in FIG. 13. With completion of the separation which produces the non-linear contour 32, two separate individual ribbons 52 and 54 are formed on the sides and the independent individual ribbon 53 in the center. While ribbon 53 has a non-linear contour along both of its edges, ribbons 52 and 53 have only one such contour. In this way a highly efficient production of different ribbons for the manufacture of flower-like decorations can be achieved.

The example embodiment of FIG. 13 does not show the entire ribbon 12, but only a certain section of a suitable length. At the end of this section of the ribbon the drawstring 28 is fastened to the ribbon 53 in the area 65. In this way the ribbon 53 can easily be pushed up along the drawstring 28 without the danger that the drawstring is simply pulled out of the ribbon. One-sided knotting of the drawstring 28 can thereby be avoided.

Figure 14:
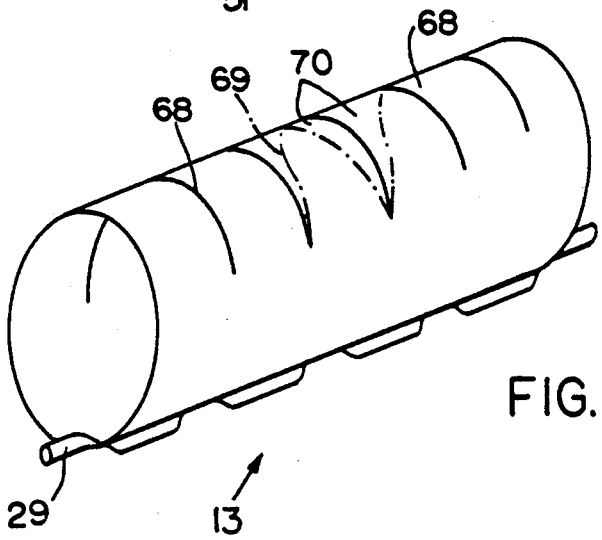
FIG. 14 is a perspective view of a further embodiment of the invention with a tubular or hose band cut into loops.

FIG. 14 shows a tubular ribbon 13, which it its longitudinal direction has at least one drawstring 29 running alternately on the inner and outer side of the tubular ribbon 13. The drawstring 29 passes through the wall of the ribbon 13 in the manner described with reference to FIGS. 1 and 2. The tubular ribbon 13 exhibits a multitude of partial circumferential cuts 68, arranged with a spacing between neighboring cuts one behind the other. The circumferential cuts 68 do not reach all the way down to the drawstring 29 so that, when the ribbon 13 is pushed together on the drawstring 29 and the ends of the drawstring are lead around in a circle to be tied together, the cuts 68 open up to form loops arranged in a circle. These loops can, when needed, be cut open at their highest points, opposite to the drawstring 29, to form individual petals. It also is advantageous to make the circumferential cuts inclined or curved as indicated by line 69. The pattern of line 69 is continued on the other, non-visible side of the ribbon 13 in a reversed direction so that, after making the cuts along the lines 69 remnants 70 are created which fall out. Such a construction results in a good shape of the flower petals especially if later the loops are cut open at their tips. In this manner a multi-layered flower with well formed petals is produced when the two ends of the drawstring 29 are tied together.

The drawstrings used are exaggerated in their thickness in the drawings. In most of the drawings the true thickness of the ribbons is not shown, except in FIGS. 2, 11, and 12.

For all example embodiments the ribbons can be dyed over their entire length or in sections or over limited regions with different colors. Coloration can also be applied to the final product after it has been produced. The drawstrings used can be made of any suitable flexible material, for example of yarn, or sufficiently flexible thin metal wire, or strings, or the like.

Figure 15:
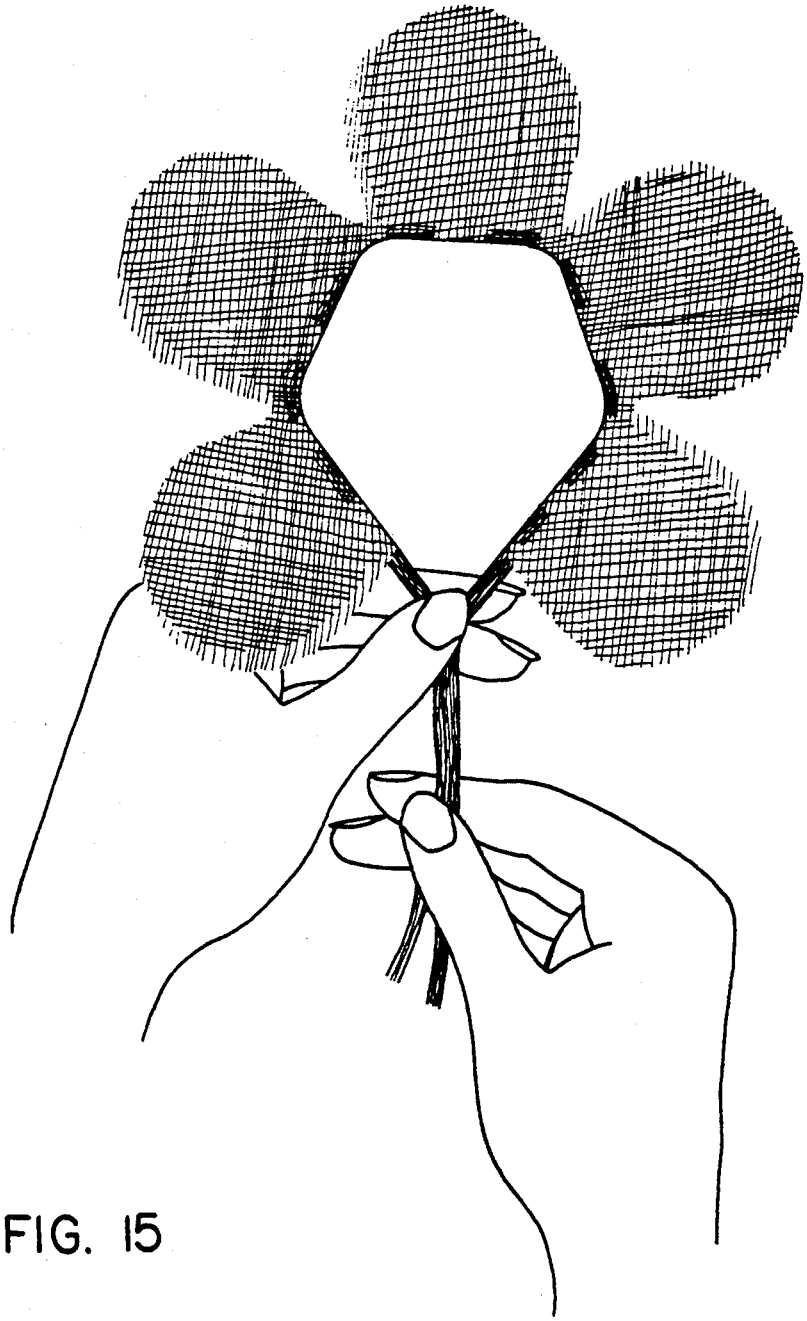
FIGS. 15 to 17 shows a flower- or blossom-like decorations made of semifinished ribbon materials according to the invention.
Figure 16:
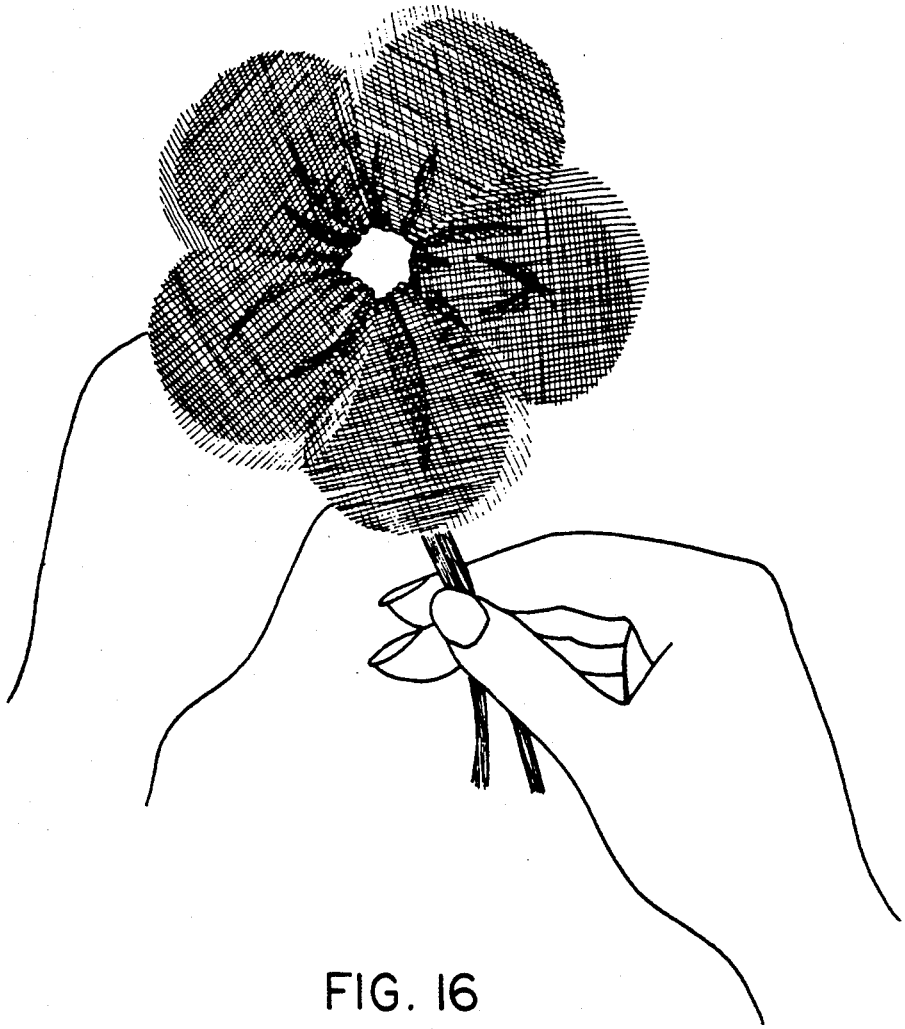
Figure 17:
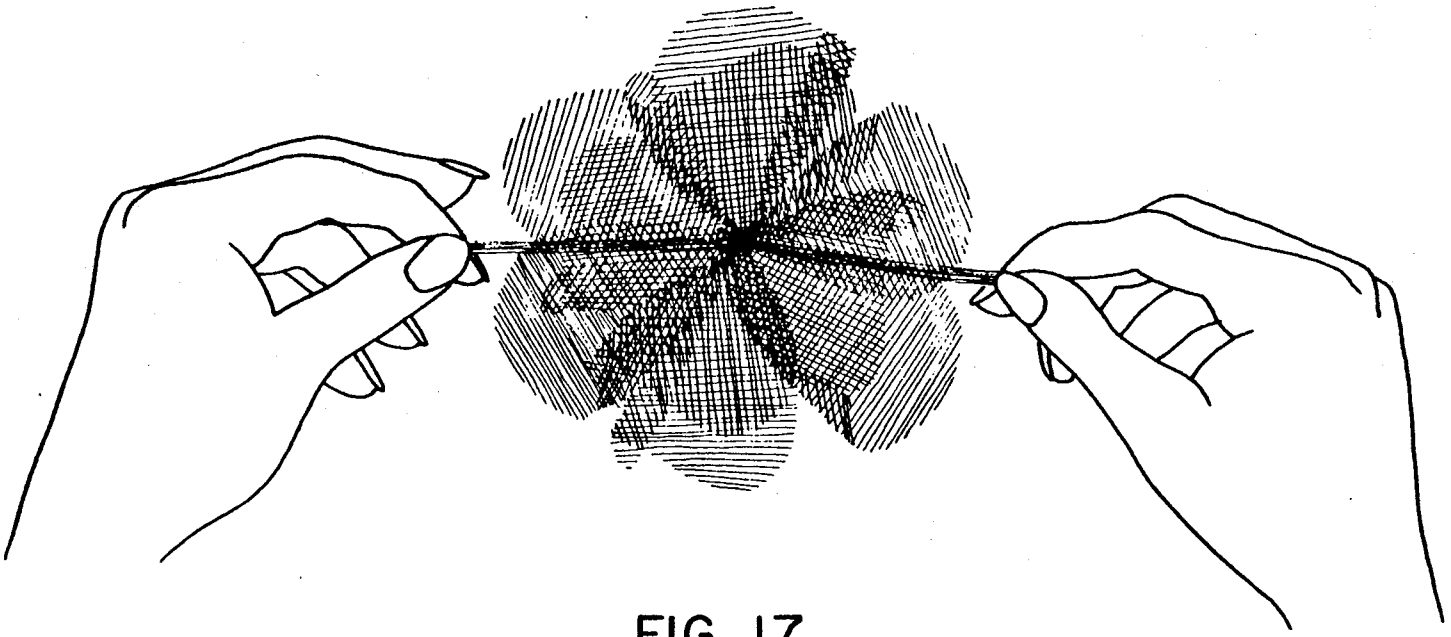

FIG. 17 shows a flower or petal decoration produced out of the semifinished ribbon materials of the invention, simply by pulling the drawstring tight and by tying a knot of the two drawstring ends where necessary as it is shown in FIG. 15 and 16.

Although the invention has been described with reference to specific example embodiments, it will be appreciated that it is intended to cover all modifications and equivalents within the scope of the appended claims.

What I claim is:

1. A method for manufacturing a semifinished material for the subsequent production of a flower or petal-like decoration, comprising the following steps:

(a) using an elongated flat ribbon material having a flexibility sufficient for a subsequent folding operation to form fold-type pleats having a desired fold and pleat size, (b) passing at least one flexible drawstring lengthwise through said flat ribbon material in a meandering fashion for establishing spacings along said elongated flat ribbon material between neighboring openings where said drawstring passes through said flat ribbon material, said drawstring running alternately on opposite sides of said flat ribbon material along said spacings (30), said spacings having a length which determines said desired fold and pleat size, (c) providing a movable connection between said flat ribbon material and said flexible drawstring through said openings and along said spacings, so that said flat ribbon material can later be gathered along said flexible drawstring for forming said fold-type pleats, and (d) forming at least one edge of said initially flat ribbon material with a curved contour to form distinct lobes which can later be gathered to form said folds as correspondingly distinct petals.

2. The method of claim 1, comprising forming both longitudinal edges of said flat ribbon material to have a non-linear, curved contour along the entire length of said flat ribbon material.

3. The method of claim 1, comprising placing said flexible drawstring close to a longitudinal center line

(33) of said flat ribbon material, so that said flexible drawstring is guided in one half of said flat ribbon material.

4. The method of claim 3, further comprising providing at least one strengthened region in said flat ribbon material, said strengthened region extending in parallel to and close to said flexible drawstring in the other half of said flat ribbon material at least in longitudinal sections of said flat ribbon material.

5. The method of claim 4, further comprising applying at least one strengthening strip to said flat ribbon material, so that said strengthening strip forms at least one strengthened region close to said flexible drawstring.

6. The method of claim 5, wherein said strengthening strip (37) extends over the entire length of said flat ribbon material close to said flexible drawstring.

7. The method of claim 5, further comprising locating said strengthening strip directly next to said center line of said flat ribbon material and close to said flexible drawstring.

8. The method of claim 1, comprising placing said flexible drawstring along a central axis of said elongated flat ribbon material.

9. The method of claim 1, providing said flat ribbon material with at least one strengthening strip on both sides of said flexible drawstring.

10. The method of claim 9, wherein both of said strengthening strips are formed as rows of strengthened regions spaced from one another longitudinally of said flat ribbon material.

11. The method of claim 9, further comprising arranging said strengthening strip or strips immediately alongside said flexible drawstring.

12. The method of claim 11, further comprising making said strengthening means of the same material as said flat ribbon material or of a different material.

13. The method of claim 1, further comprising providing said flat ribbon material with strengthening means arranged within or on said flat ribbon material.

14. The method of claim 1, wherein said combining step is performed by sewing said flexible drawstring to or into said flat ribbon material at one securing location to permit said gathering into said distinct petals.

15. The method of claim 1, wherein said flat ribbon material has one straight edge, and wherein said flexible drawstring is placed immediately next to said straight edge.

16. The method of claim 1, wherein said step of forming said curved contour, at least along one edge of said flat material is performed by cutting or punching.

17. The method of claim 1, further comprising using as said initially flat ribbon material a tubular ribbon (13) of sufficiently flexible material, movably attaching to said tubular ribbon at least one flexible drawstring (29) running in a lengthwise direction of said tubular ribbon and being sectionally not covered by said tubular ribbon (13), and making circumferential cuts (61) at lengthwise regular or irregular intervals into said tubular ribbon.

18. The method of claim 1, further combining combining said flat ribbon material (3.1) with at least one tubular ribbon (3.2) along a straight edge of said flat ribbon material (3.1), and movably connecting a drawstring (18) to a connecting zone between said flat material and said tubular ribbon.

19. The method of claim 1, further comprising rigidly securing said flexible drawstring to said flat material at least at one location or at given longitudinally spaced points.

20. The method of claim 1, wherein said curved contour is formed as one of a wavy, arching, and arcade-like configuration.

21. The method of claim 1, further comprising movably connecting to said flat ribbon material an additional draw means (63) which extends partly in the longitudinal direction and partly curves along said curved contour toward a highest point of at least one arc or wave crest and back down again.

22. The method of claim 1, further comprising using as said flexible drawstring a sufficiently flexible material wire.

23. The method of claim 1, for simultaneously forming two sections of said semifinished material, comprising using as said flat ribbon material a tubular flat material, movably connecting to said tubular flat material two longitudinal drawstrings (21, 22) diametrically opposite each other, laying said tubular material flat in such a way that respective folding edges each run next to one of said drawstrings (21, 22), and then cutting or stamping through both walls of said tubular flat material between said two drawstrings (21, 22) so that two flat ribbons are formed each with a non-linear contour on each of its two edges (32).

24. The method of claim 1, further comprising providing said flat ribbon material with crosswise tear-off markings at prescribed longitudinal intervals.

25. A method for manufacturing a semifinished material for the subsequent production of a flower or petal-like decoration, comprising the following steps:

(a) using an elongated initially flat material having a flexibility sufficient for a subsequent folding operation to form fold-type pleats having a desired fold size, (b) establishing along said elongated flat material between neighboring locations, spacings (30) along which an elongated, also sufficiently flexible draw means is to be not covered by said initially flat material, said spacings having a length which determines said desired fold size, (c) combining said elongated sufficiently flexible draw means longitudinally with said flat material to provide a movable connection between said flat material and said draw means between said spacings, so that said flat material can later be gathered along said draw means for forming said fold-type pleats, (d) forming at least one edge of said initially flat material with a curved contour to form distinct lobes which can later be gathered to form said pleats as correspondingly distinct petals, and wherein said combining step comprises providing said flat material along a straight edge (43) with a multitude of spaced tongues (44) arranged with a spacing (45) between neighboring tongues, folding said tongues over, securing said tongues to said flat material to form open-ended pockets (67), and threading said draw means through said pockets, whereby said draw means is covered by the pockets and not covered between the pockets.

26. The method of claim 16, wherein all of said spacings (45) between said tongues (44) have the same length or at least some spacings have a different length compared to other spacings, and wherein said tongues have a length (47) that is either the same for all tongues or different for at least some tongues.

27. A method for manufacturing a semifinished material for the subsequent production of a flower or petal-like decoration, comprising the following steps:

(a) using an elongated initially flat material having a flexibility sufficient for a subsequent folding operation to form fold-type pleats having a desired fold size, (b) establishing along said elongated flat material between neighboring locations, spacings (30) along which an elongated, also sufficiently flexible draw means is to be not covered by said initially flat material, said spacings having a length which determines said desired fold size, (c) combining said elongated sufficiently flexible draw means longitudinally with said flat material to provide a movable connection between said flat material and said draw means between said spacings, so that said flat material can later be gathered along said draw means for forming said fold-type pleats, (d) forming at least one edge of said initially flat material with a curved contour to form distinct lobes which can later be gathered to form said pleats as correspondingly distinct petals, and wherein said flat material (12) initially has two straight parallel edges (48, 49), combining one drawstring (50, 51) with said flat material along each of said edges (48, 49), combining another drawstring (28) with said flat material centrally between said first mentioned drawstrings (50, 51), whereby each of said drawstrings (28, 50, 51) forming said draw means is sectionally not covered longitudinally along said spacings, and forming a non-linear curved contour (32) in said flat material between said other drawstring (28) and said first mentioned drawstrings (50, 51) to separate said flat material into three individual ribbons (52, 53, 54), one of which has two curved edges.

28. The method of claim 19, wherein said flat ribbon material (12) is folded over along said central drawstring (28) and cut or punched in this folded condition.

29. A method for manufacturing a semifinished material for the subsequent production of a flower or petal-like decoration, comprising the following steps:

(a) using an elongated initially flat material having a flexibility sufficient for a subsequent folding operation to form fold-type pleats having a desired fold size, (b) establishing along said elongated flat material between neighboring locations, spacings (30) along which an elongated, also sufficiently flexible draw means is to be not covered by said initially flat material, said spacings having a length which determines said desired fold size, (c) combining said elongated sufficiently flexible draw means longitudinally with said flat material to provide a movable connection between said flat material and said draw means between said spacings, so that said flat material can later be gathered along said draw means for forming said fold-type pleats, further comprising combining more than two ribbons (5, 6, 7) of flat ribbon material along a first common edge (55) while each second edge (56, 57, 58) remains free, movably connecting a straight running flexible drawstring (23) in the area of said common edge, and providing at least one of said free edges (56, 57, 58) with a curved contour to form distinct lobes which can later be gathered to form said pleats as correspondingly distinct petals.

30. The method of claim 21, further comprising providing at least that ribbon (5) which shall have the non-linear contour (31), with a further drawstring (60) next to its free straight edge, and then severing the ribbon (5) between said further drawstring (60) and said central drawstring (23) for forming a non-linear contour for said ribbon (5) and for a portion severed and provided with said further drawstring.

* * * * *

UNITED STATES PATENT AND TRADEMARK OFFICE

CERTIFICATE OF CORRECTION

PATENT NO. : 5,144,728

DATED : September 8, 1992

INVENTOR(S) : Ernst Hagenbuch

It is certified that error appears in the above-identified patent and that said Letters Patent is hereby corrected as shown below:

Claim 1, column 10, line 39, after "elongated" insert --initially--.

Claim 18, column 11, line 61, replace "combining" by --comprising--.

Claim 22, column 12, line 13, replace "material" by --metal--.

Claim 26, column 12, line 63, replace "claim 16" by --claim 25--.

Claim 28, column 14, line 1, replace "claim 19" by --claim 27--.

Claim 30, column 14, line 33, replace "claim 21" by --claim 29--.

Signed and Sealed this

Seventh Day of September, 1993

Bruce Lehman

*Attest:*

BRUCE LEHMAN

*Attesting Officer*

*Commissioner of Patents and Trademarks*